United States Patent [19]

Irie et al.

[11] Patent Number: 4,640,872

[45] Date of Patent: Feb. 3, 1987

[54] CORROSION-RESISTANT STEEL STRIP HAVING ZN-FE-P ALLOY ELECTROPLATED THEREON

[75] Inventors: Toshio Irie; Kazuaki Kyono; Hajime Kimura; Shigeo Kurokawa, all of Chiba, Japan

[73] Assignee: Kawasaki Steel Corporation, Hyogo, Japan

[21] Appl. No.: 818,909

[22] Filed: Jan. 15, 1986

Related U.S. Application Data

[63] Continuation of Ser. No. 609,752, May 14, 1984, abandoned.

[30] Foreign Application Priority Data

May 14, 1983 [JP] Japan ..... 58-84584

[51] Int. Cl.[4] ..... B32B 15/01

[52] U.S. Cl. ..... 428/659; 204/44.2; 420/513; 428/935

[58] Field of Search ..... 428/659, 935; 204/44.2; 427/433; 420/513

[56] References Cited

U.S. PATENT DOCUMENTS

| | | | |
|---|---|---|---|
| 1,273,358 | 7/1918 | Gravell | 428/659 |
| 2,082,225 | 6/1937 | Spowers et al. | 427/433 |
| 3,271,276 | 9/1966 | Di Guillio et al. | 204/44.7 |
| 4,101,389 | 7/1978 | Uedaira | 204/44.7 |
| 4,407,899 | 10/1983 | Hara et al. | 428/659 |

FOREIGN PATENT DOCUMENTS

| | | | |
|---|---|---|---|
| 1105189 | 3/1968 | United Kingdom . | |
| 571528 | 9/1977 | U.S.S.R. | 204/44.2 |

OTHER PUBLICATIONS

Patent Abstracts of Japan; unexamined applications, C field, vol. 7, No. 53, Mar. 3, 1983; The Patent Office Japanese Government; p. 46 C 154; Kokai-No. 57-200 589, (Nippon Kokan K.K.).

*Primary Examiner*—Melvyn J. Andrews
*Assistant Examiner*—Robert L. McDowell
*Attorney, Agent, or Firm*—Young & Thompson

[57] ABSTRACT

Steel strips having a Zn-Fe-P alloy electroplated thereon exhibit improved corrosion resistance, particularly perforation corrosion resistance, as long as the plating contains 5 to 30% by weight of iron and 0.0003 to 0.5% by weight of phosphorus.

3 Claims, 3 Drawing Figures

CORROSION-RESISTANT STEEL STRIP HAVING ZN-FE-P ALLOY ELECTROPLATED THEREON

This application is a continuation of application Ser. No. 609,752, filed May 14, 1984, now abandoned.

BACKGROUND OF THE INVENTION

This invention relates to steel strips or sheets having improved corrosion resistance with or without a paint coating and press workability, and more particularly, to such surface-treated steel strips for use in automobiles.

Among surface treated steel strips, zinc coated steel has found the widest variety of applications, for example, in automobiles, electric appliances, building material and the like because of its improved sacrificial corrosion prevention effect. Recently, the need for rust prevention has been increased in some applications and it has been desired to enhance the rust prevention of zinc coated steel. There has been the need for imparting heavy duty rust prevention to zinc coated steel because the rust prevention that current zinc-coated steel possesses is still insufficient in certain applications. More illustratively, zinc coated steel strips have poor phosphatability, paintability, and wet adhesion of paint coating, and deteriorate in corrosion resistance during service at joints such as hemmed joints as often formed in automobile doors whether or not they are coated with paint. A closer attention has been paid to these drawbacks and there is the strong desire to overcome them. Particularly, surface treated steel strips for use in automobiles are required to have improved corrosion resistance with or without paint coating, particularly improved perforation corrosion resistance at joints as well as good weldability, workability, phosphatability and paintability.

Among prior art conventional surface treated steel strips, there are known galvannealed steel strips which satisfy the above requirements to some extent as they possess exceptionally high corrosion resistance after paint coating. The galvannealed steel is prepared by subjecting steel to zinc hot-dipping or zinc electroplating followed by a heat treatment to form a Zn-Fe alloy coating having a major proportion of $\delta_1$ phase. This process is well known for decades in the art and galvannealed steel often exhibits good corrosion resistance after paint coating. The need for heat treatment, however, detracts from the mechanical properties of steel strips and is unsuccessful in providing steel strips with such a high degree of strength and workability as is currently required for automobile use. Further, when thinly coated, galvannealed steel strips do not possess satisfactory local corrosion resistance or perforation corrosion resistance during service at joints like hemmed joints.

In order to eliminate the above-mentioned shortcomings of galvannealed steel while taking advantage of its excellent corrosion resistance with or without paint coating, Zn-Fe alloy electroplating has recently been used as an improvement over the galvannealing as disclosed in Japanese Patent Application Kokai Nos. SHO 54-107838, 57-60087 and 57-200589, and Japanese Patent Publication No. SHO 57-61831, for example. The Zn-Fe alloy electroplating is substantially equivalent to galvannealing in as to corrosion resistance with or without paint coating, paint adhesion, phosphatability and weldability where the content of iron is in the range of 5% to 30% by weight. Since these results are obtained by carrying out electroplating so as to achieve the properties of galvannealed coatings, it is not expectable that properties other than workability might exceed those of galvannealed coatings. It is believed that corrosion resistance which is most important among others is improved because the alloy is more noble in corrosion potential than pure zinc and thus exhibits a smaller potential difference with respect to the underlying steel. In addition, microcells form in the deposit as well as corrosion products contaminated with iron. These factors together result in a reduced rate of corrosion.

OBJECT OF THE INVENTION

It is, therefore, an object of the present invention to improve Zn-Fe alloy electroplated steel with respect to corrosion resistance, particularly at joints.

SUMMARY OF THE INVENTION

The inventors have found that the corrosion resistance of Zn-Fe alloy electroplated steel can be remarkably improved by codepositing a minor proportion of phosphorus in the Zn-Fe alloy plating.

According to the present invention, there is provided a corrosion-resistant steel strip having a Zn-Fe-P alloy electroplated on at least one surface thereof, the alloy plating consisting essentially of 5% to 30% by weight of iron, 0.0003% to 0.5% by weight of phosphorus and the balance of zinc based on the total weight of the plating.

BRIEF DESCRIPTION OF THE DRAWINGS

In order that those skilled in the art will better understand the practice of the present invention, the following description will be given in conjunction with the accompanying drawings, in which.

DETAILED DESCRIPTION OF THE INVENTION

The steel strips or sheets having Zn-Fe-P alloy electroplated thereon according to the present invention exhibit very unique performance in that they have improved corrosion resistance with or without paint coating, and are particularly unsusceptible to local corrosion or perforation corrosion at plate joints and crosscuts while other properties such as weldability, phosphatability and paintability remain comparable to those of prior art Zn-Fe alloy electroplated steel.

Figure 1:
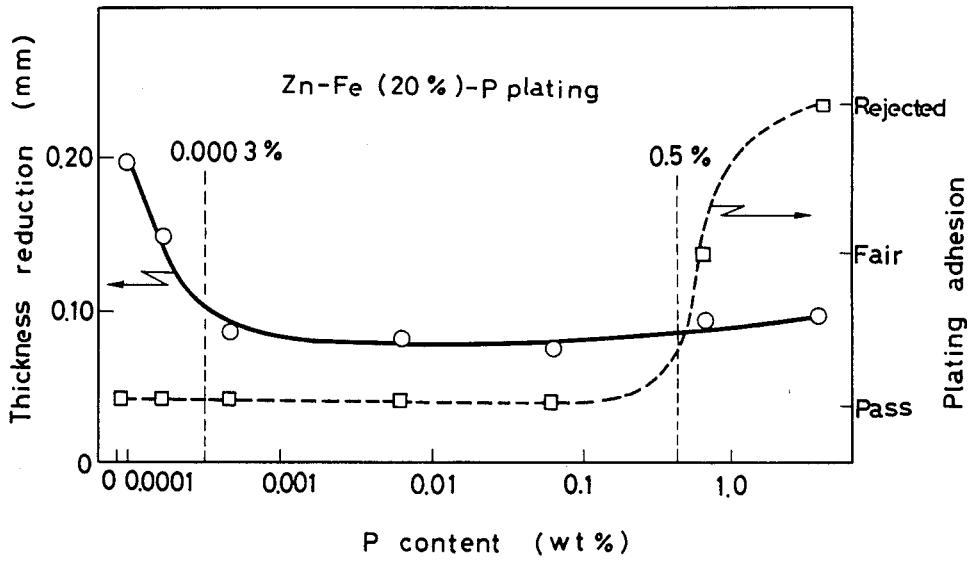
FIG. 1 is a graph in which the thickness reduction and plating adhesion of steel strips having Zn-Fe-P alloy electroplated thereon are plotted in relation to the content of P.
Figure 2:
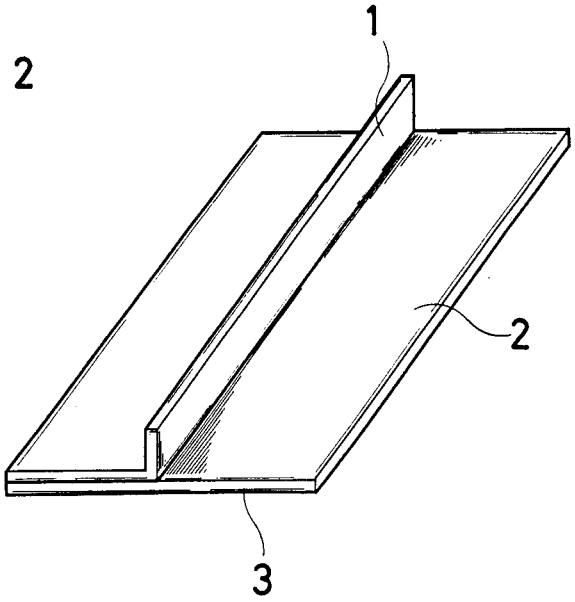
FIG. 2 is a perspective view of an assembly of overlapped pieces subject to a cyclic corrosion test.

These improved properties are demonstrated in FIG. 1. Cold rolled steel strips were electroplated with Zn-Fe-P alloys having varying phosphorus contents. The iron content was 20% by weight in this experiment although similar results are obtained with iron contents in the range of 5% to 30% by weight as will become evident later. As shown in FIG. 2, a cold rolled steel piece 1 was placed on the plating surface 2 of a plated steel piece 3 such that the former overlapped the latter over a substantial surface area. The assembly of steel pieces 1 and 3 was subjected to a cyclic corrosion test for the overlapped area or joint. The assembly was phosphated and then coated with a film of 10 μm thick by cathodic electrophoretic painting before it was subjected to a cyclic corrosion test for 30 days. Each cycle of the cyclic test included 7 hours of salt spraying, 2 hours of drying at 70° C., 1 hour of dipping in salt water, and 2 hours of drying at room temperature. At the end of the test, a reduction in the thickness of the plated steel piece was determined to evaluate the perforation corrosion resistance of the overlapped area. The results are plotted in the graph of FIG. 1, which shows that steel strips having Zn-Fe-P alloy electroplatings containing minor proportions of phosphorus exhibit remarkably improved perforation corrosion resistance as compared with steel strips having phosphorus-free Zn-Fe alloy electroplatings. Similar results will be obtained when P is replaced by an element of Group Va in the Periodic Table, that is, As, Sb or Bi.

The content of phosphorus (P) in the Zn-Fe-P alloy electroplating is limited to 0.0003% to 0.5% by weight, and preferably 0.003% to 0.3% by weight based on the weight of the plating. Contents of phosphorus of less than 0.0003% by weight are too low to achieve an effect distinguishable from Zn-Fe alloy platings. Contents of phosphorus of more than 0.5% by weight do not further improve corrosion resistance and detract from plating adhesion.

The content of iron (Fe) in the Zn-Fe-P alloy platings is limited to 5% to 30% by weight, and preferably 10% to 25% by weight based on the weight of the platings. Platings containing less than 5% by weight of iron show properties similar to those of pure zinc, that is, insufficient corrosion resistance and paintability. Contents of iron of more than 30% by weight reduce the sacrificial corrosion prevention of zinc itself, detracting from corrosion resistance.

Although it is not clearly understood why the presence of P in Zn-Fe-P platings is effective in improving corrosion resistance, it is believed that the codeposition of P in Zn-Fe platings causes numerous microcells to form in the plating layer, which in turn, causes corrosion to proceed more uniformly in Zn-Fe-P platings than in Zn-Fe platings, resulting in a reduced total rate of corrosion. In addition, corrosion products containing phosphorus form and they are effective in mitigating local corrosion and improving corrosion resistance. As will be understood from the foregoing, the Zn-Fe-P alloy electroplatings take advantage of the excellent corrosion prevention of zinc itself (due to sacrificial corrosion prevention and corrosion products), and therefore, both upper and lower limits must be imposed on the optimum ranges of iron and phosphorus contents.

Although the invention is described in connection with Zn-Fe-P ternary alloy platings, the alloy composition which can be used herein may further contain an inevitable proportion of one or more elements selected from Cu, Ni, Cr, Co, Mn, Mo, V, Sn, Cd, Al, $Al_2O_3$, $SiO_2$, B and the like. The inclusion of such concomitant elements does not substantially alter the results shown in FIG. 1 and Table 1 as long as Fe is in the range of 5% to 30% by weight and P in the range of 0.0003% to 0.5% by weight.

The process of preparing steel strips having a Zn-Fe-P alloy electroplated thereon according to the present invention will be described by way of illustration and not by way of limitation.

Steel strips or sheets having a Zn-Fe-P alloy electroplated thereon may be easily prepared by the electroplating process using a conventional Zn-Fe plating bath under ordinary Zn-Fe plating conditions, provided that a controlled amount of a phosphorus source, for example, sodium hypophosphite is added to the bath. It has been found that the content of P in the plating is little affected by the current density and the flow rate of plating solution, which are significant parameters in the plating process, but largely depends on the content of Fe in the plating and the concentration of a phosphorus source, for example, sodium hypophosphite in the plating solution. For this reason, the Zn-Fe-P alloy can be relatively easily deposited as compared with other ternary alloys.

Figure 3:
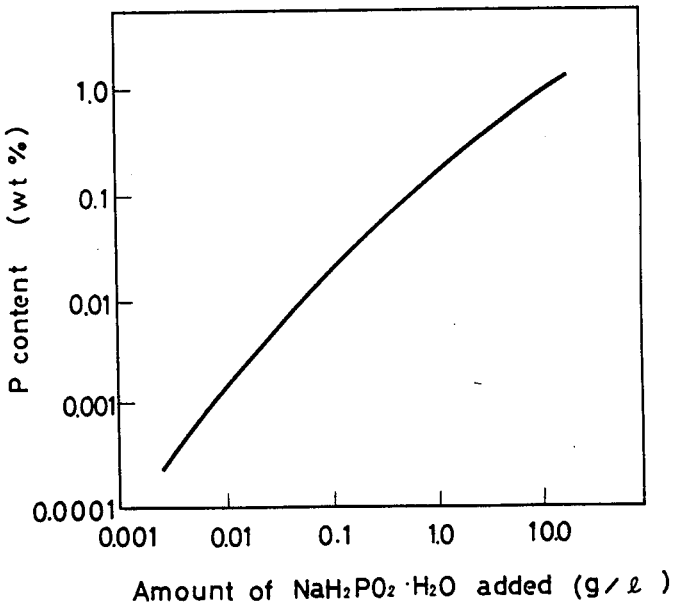
FIG. 3 is a graph showing the content of P in platings in relation to the amount of $NaH_2PO_2.H_2O$ added in a Zn-Fe-P alloy electroplating bath.

FIG. 3 shows percent phosphorus content versus the amount of sodium hypophosphite ($NaH_2PO_2$) added. A Zn-Fe-P alloy was deposited using a plating bath having the following composition while the concentration of $NaH_2PO_2$ was varied in the range of 0.001 to 10.0 g/l. The content of Fe was kept at a substantially constant level of 20% by weight.

(1) Plating bath composition
  $FeCl_2.nH_2O$: 100 g/l
  $ZnCl_2$: 200 g/l
  $NH_4Cl$: 300 g/l
  Ammonium citrate: 5 g/l
(2) Current density: 100 A/dm$^2$
(3) pH: 3
(4) Bath temperature: 50° C.

The results are shown in FIG. 3 which reveals that the phosphorus content is approximately proportional to the amount of the phosphorus source added.

Examples of the Zn-Fe-P alloy electroplated steel according to the present invention will be described by way of illustration and not by way of limitation.

EXAMPLES

Cold rolled steel strips were electrolytically degreased and pickled in a conventional manner before they were electroplated with Zn-Fe-P alloys in the same manner as described above. The plating parameters were controlled so as to vary the Fe and P contents and the build-up of the resultant platings. A variety of tests were performed on the thus obtained steel strips having Zn-Fe-P electroplatings thereon.

Perforation Corrosion Resistance at Joint

Assemblies as shown in FIG. 2 were treated with a phosphate (trade name Bonderite #3004, Nihon Parkerizing K.K.) and then coated with a paint film of 10 μm thick by cathodic electrophoretic painting using Power-Top U-30 (trade name, Nihon Paint K.K.) before they were subjected to 90 cycles of cyclic corrosion test, each cycle consisting of 7 hours of salt spraying, 2 hours of drying at 70° C., 1 hour of dipping in salt water, and 2 hours of drying at room temperature. A reduction in thickness of the test piece was measured to evaluate the perforation corrosion resistance at the joint or overlapped area. Evaluation is on the following criterion.

Pass: 0–0.10 mm
Fair: 0.10–0.20 mm
Rejected: 0.20 mm or more

Perforation Corrosion Resistance at Cross-Cut After Painting

Assemblies which were phosphated and subjected to cathodic electrophoresis painting by the same procedure as above were formed with cross cuts before they were subjected to the same cyclic corrosion test as above for evaluation.

Blister Spread After Painting

Assemblies which were phosphated and subjected to cathodic electrophoresis painting by the same procedure as above were formed with cross cuts before they were subjected to the same cyclic corrosion test. Blisters grew from the cross cuts. The spread of the blisters was measured from the cross cuts. Evaluation is on the following criterion.

Pass: 0–3 mm

Fair: 3–5 mm

Rejected: 5 mm or more

Workability

An electroplated strip was subjected to OT bending (180° bending) with the plated surface outside. Once attached to the plating surface of the strip bent, an adhesive tape was removed to examine how the plating was peeled from the underlying steel due to adhesion to the tape. Evaluation is on the following criterion.

Pass: no peeling

Fair: some peeling

Rejected: considerable peeling

The results are shown in Table 1.

TABLE 1

| Sample | Deposit Fe content (wt %) | Deposit P content (wt %) | Build-up ($g/m^2$) | Properties Perforation Corrosion Resistance at joint | Properties Perforation Corrosion Resistance at cross-cut | Blister spread | Workability |
|---|---|---|---|---|---|---|---|
| Example 1 | 6 | 0.10 | 25 | Pass | Pass | Fair | Pass |
| Example 2 | 15 | 0.0005 | 20 | Pass | Fair | Pass | Pass |
| Example 3 | 15 | 0.01 | 20 | Pass | Pass | Pass | Pass |
| Example 4 | 22 | 0.005 | 30 | Pass | Pass | Pass | Pass |
| Example 5 | 22 | 0.41 | 20 | Pass | Fair | Pass | Pass |
| Example 6 | 30 | 0.03 | 20 | Pass | Pass | Pass | Pass |
| Comparative Example 1 | 20 | 0 | 30 | Fair | Fair | Pass | Pass |
| Comparative Example 2 | 25 | 1.5 | 20 | Pass | Fair | Fair | Rejected |
| Comparative Example 3 | 3 | 0.2 | 20 | Rejected | Rejected | Rejected | Pass |
| Comparative Example 4 | 35 | 0.1 | 20 | Rejected | Rejected | Rejected | Pass |
| Comparative Example 5* | (10) | 0 | 45 | Fair | Fair | Pass | Rejected |

*galvannealed steel

As is apparent from the data of Table 1, the steel strips having Zn-Fe-P alloys electroplated thereon according to the present invention are superior to a conventional well-known steel strip having a phosphorus-free Zn-Fe alloy electroplated thereon (Comparative Example 1) and a galvannealed steel strip (Comparative Example 5) with respect to perforation corrosion resistance at joints, perforation corrosion resistance at cross-cuts after painting, wet adhesion of paint coatings, and workability.

The data of Table 1 also show that the benefits of the present invention are derived from Zn-Fe-P alloy electroplatings as long as the iron content falls in the range of 5 to 30% and the phosphorus content in the range of 0.0003 to 0.5% by weight.

Also, weldability, phosphatability, and the prevention of red rust formation at cross-cuts after painting were found satisfactory in the examples shown in Table 1.

What is claimed is:

1. A Zn-Fe-P electroplated steel strip having improved corrosion resistance with or without a paint coating and press workability for use in automobiles, said steel strip having a Zn-Fe-P ternary alloy electroplated on at least one surface thereof, said alloy plating consisting essentially of 5% to 30% by weight of iron, 0.0003% to 0.5% by weight of phosphorus, and the balance of zinc based on the weight of the plating.

2. The steel strip according to claim 1 wherein the phosphorus content of said plating ranges from 0.003% to 0.3% by weight.

3. The steel strip according to claim 1 wherein the iron content of said plating ranges from 10% to 25% by weight.

* * * * *